US005318234A

United States Patent [19]

Biggs et al.

[11] Patent Number: 5,318,234

[45] Date of Patent: Jun. 7, 1994

[54] AUTOMATIC WIRE DE-SPOOLER FOR WIRE BONDING MACHINES

[75] Inventors: Kenneth L. Biggs, Orange, Calif.; Richard Gordon, Scarsdale, N.Y.

[73] Assignees: West Bond Inc., Anaheim, Calif.; SPM Corporation, Mamaroneck, N.Y.

[21] Appl. No.: 934,258

[22] Filed: Aug. 25, 1992

[51] Int. Cl.[5] ..... B65H 59/04

[52] U.S. Cl. ..... 242/54 R

[58] Field of Search ..... 242/54 R, 45, 147 A

[56] References Cited

U.S. PATENT DOCUMENTS

| | | | |
|---|---|---|---|
| 4,019,669 | 4/1977 | Tanimoto et al. | 242/147 A |
| 4,498,638 | 2/1985 | Kurtz et al. | 242/45 |
| 4,530,471 | 7/1985 | Inoue | 242/54 R |
| 4,763,826 | 8/1988 | Kulicke et al. | 242/147 A X |
| 4,899,945 | 2/1990 | Jones | 242/45 |
| 4,909,431 | 3/1990 | Japichino et al. | 242/147 A |
| 5,137,223 | 8/1992 | Brandon et al. | 242/54 R |

*Primary Examiner*—John M. Jillions

*Attorney, Agent, or Firm*—William L. Chapin

[57] ABSTRACT

A de-spooler apparatus for paying out fine wire from a spool of wire, for use in wire bonding machines, maintains a relatively constant slack length of wire within the apparatus, thereby allowing wire to be drawn from the machine as needed with a minimum amount of tension exerted on the wire. The apparatus includes a spool drive motor for paying out wire from a spool, a hairpin-shaped bail for containing a slack length of wire, and a nozzle for directing a stream of pressurized gas downwards into the open end of the bail, causing wire within the bail to form a curved slack length. The apparatus also includes a proximity-type feed sensor for detecting when the slack length straightens and shortens a predetermined amount, bringing the slack length into the detection range of the feed sensor, which outputs an electrical signal that causes the drive motor to rotate in a forward sense, paying off wire from the supply spool and increasing the slack length. The preferred embodiment also includes an end-of-spool sensor for producing a status signal indicating that nearly all of the wire on a spool has been paid out.

23 Claims, 3 Drawing Sheets

AUTOMATIC WIRE DE-SPOOLER FOR WIRE BONDING MACHINES

BACKGROUND OF THE INVENTION

The present invention relates to an apparatus for use with wire bonding machines, of the type used to bond fine conductive wires to miniature electronic devices, such as integrated and hybrid micro-circuit chips. More particularly, the invention relates to an automatic wire de-spooler apparatus for paying out wire for use by such bonding machines.

B. Description of Background Art

Miniature electronic circuits, or micro-circuits are used in vast quantities, in a wide variety of consumer, commercial, industrial and military apparatus. The majority of such micro-circuits are of a type referred to as integrated circuits. Integrated circuits contain a large number of active circuit elements such as transistors, and passive elements such as resistors and capacitors. In semiconductor integrated circuits, conductive paths between circuit elements on a semiconductor substrate are formed by selectively etching the substrate. In hybrid micro-circuits, circuit elements mounted on a ceramic substrate are usually interconnected, typically by conductive ink paths on the substrate.

The functional portions of integrated circuits are typically in the form of very small, rectangular-shaped chips, ranging in size from 0.025 inch to 0.200 inch or more on a side. Input connections to integrated circuit chips are often made by bonding a very fine wire to conductive pads on the chips, the other end of each wire being bonded to a conductive terminal that is sufficiently large and robust to be inserted into a printed circuit board and soldered to conductors on the board.

Typically, bonding wire used to interconnect the pads of a semiconductor chip to terminals of a package containing the chip is made of aluminum or gold, and is quite fine, having a diameter of about 1 mil. (0.001 inch). This wire must be bonded to small, typically rectangular-shaped, integrated circuit pads a few mils on a side.

The most common method of interconnecting wires between semiconductor chip pads and external terminals is to form a weld or bond at each end of a conducting wire. The bonds are formed by the application of heat, ultrasonic energy, or a combination of both. To form such bonds, the free end of a length of bonding wire is placed in contact with a pad. Then the tip of an ultrasonic transducer is pressed against the wire, and energized with ultrasonic energy for a short time interval, welding the wire to the pad. The unbonded length of wire is then moved to other pads, and bonded thereto by the same process. After the last bond in a series of bonds has been thus formed, the wire is severed near the last bond.

Typical wire bonding machines used for ultrasonic welding of wires to micro-circuit pads include an elongated, vertically disposed, force-applying member or "tool." The tool is connected at the upper end thereof to a source of ultrasonic energy, such as a piezoelectric transducer connected to an electrical energy source alternating at an ultrasonic frequency. Usually, the tool is connected to the transducer through a tapered horn structure that matches the acoustic input impedance of the small tool to the output impedance of the larger transducer.

Ultrasonic bonding tools used to bond wires to microcircuit pads generally have a flat lower working face adapted to press a bonding wire into contact with a pad, while ultrasonic energy is applied through the tool to the wire to form an ultrasonic weld. This working face is usually quite small, typically having a rectangular shape only about a few mils along a side. The working face must be quite small to permit bonding to small micro-circuit pads, without contacting adjacent circuit elements. Typically, this is done while viewing the pad and tool tip in a stereo microscope.

In most wire bonding machines, the bonding tool is adapted to manipulate bonding wire over a pad, prior to performing the bonding operation. Such bonding tools may include an upwardly angled lower face rearward of the working face, and a generally vertically disposed rear face. An angled bore or guide hole having an entrance aperture in the rear face and an exit aperture in the angled lower face permit bonding wire from a spool mounted upward and rearward of the tool to be paid out through the exit aperture of the angled lower face. Typically, a remotely actuable clamp located rearward of the guide hole entrance and movable with the tool is used to feed bonding wire through the guide hole of the tool.

The clamp used to effect movement of wire through the guide hole of a bonding tool usually consists of a pair of jaws that may be closed to grip the wire, or opened to allow free travel of the wire. Generally, such clamps may be moved toward and away from the guide hole entrance, typically on a line of movement which coincides with the axis of the guide hole. To feed wire through the guide hole, the jaws of the clamp are first opened, and the clamp then moved away from the guide hole. The jaws are then closed to grip the wire, and then moved towards the guide hole, thus feeding wire through the guide hole.

In wire bonding machines of the type just described, the machine is used to move the bonding tool to the proper position to bond wire to a pad, feed wire out through the guide hole exit aperture, move the tool to another pad and form another bond. In this manner, any desired number of pads or other elements of a circuit can be connected together, in a procedure referred to a "stitch" bonding. After the last bond in a series of bonds has been made, the wire must be severed, to permit making other, unconnected bonds. Oftentimes, the bonding tool itself is utilized to sever the bonding wire.

The bonding machines described above are often referred to a "wedge bonding bonders," owing to the shape of the ultrasonic tool tip used to make bonds. Another type of bonding machine uses a fine wire, usually made of gold, that protrudes through a capillary tube and is melted with a miniature torch to form a bond consisting of a fused ball at the end of the wire.

Both wedge bonding and capillary ball bonding operations require that the bonding wire be supplied to the tip of the bonding tool with very little drag or tension. Even a small amount of drag can make the "tail," or length of wire at a bond site to be too short, resulting in a bond of insufficient strength. Too much drag can also result in loops between bonds that are too short. Excessive drag can even result in wire breakage.

From the discussion above, it should be evident that it is desirable to provide sufficient slack in the wire supply of wire bonding machines to ensure that minimum drag is placed on the wire. One prior art approach to maintaining slack in wire supplied to bonding machine uses helical loops of wire paid axially off the end of a stationary spool, similar to the operation of a spinning reel used for fishing. This method of paying out wire, sometimes referred to as "ballooning," has the disadvantage of imposing a torsion on wire paid out, causing the wire to pick up a twist. Point-to-point connections made with wire twisted in this manner tends to bend away from a vertical plane normal to the horizontal plane containing a microcircuit substrate and conductive pads, a condition referred to variously as "sweeping" or "dog-legging." This condition is undesirable, since wire sweep or dog-legging can degrade bond strength, and if sufficiently large, cause bonding loops to short out against one another or even against the microcircuit itself. Another prior art method of providing slack in the wire supplied to a wire bonder uses a motor-driven spool. In this type of device, the motor receives pre-programmed signals causing it to rotate intermittently in controlled increments. The present invention was conceived of to provide an improved means for supplying wire to wire bonding machines, while maintaining a precisely controlled amount of slack in the wire.

OBJECTS OF THE INVENTION

An object of the present invention is to provide a wire de-spooler for wire bonding machines that pays out wire upon demand, while maintaining the wire in a slack condition.

Another object of the invention is to provide a wire despooler that pays out slack wire, without imparting a twist to the wire.

Another object of the invention is to provide a wire despooler that automatically maintains a relatively constant length of wire between a wire supply and an outlet aperture of the despooler in a slack condition.

Another object of the invention is to provide an automatic wire de-spooler that has sensor means responsive to a decrease in the length of a slack length of wire effective in increasing the slack length to a pre-determined value.

Another object of the invention is to provide an automatic wire de-spooler having a wire-spool drive motor adapted to rotate the spool in a direction in which wire is paid out from the spool, thereby increasing the slack length, in response to a signal from sensor means detecting a decrease in slack length.

Another object of the invention is to provide an automatic wire de-spooler having a spool drive motor responsive to external command signals in paying out wire.

Another object of the invention is to provide an automatic wire de-spooler having an end-of-spool sensor that produces a status signal indicating that all of the wire on a spool has been paid out.

Another object of the invention is to provide an automatic wire de-spooler having means responsive to the presence of an excessive slack length in rewinding wire on the spool.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described in this specification are merely illustrative of the preferred embodiment. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention contemplates an apparatus for paying out fine wire from a spool of wire, i.e., despooling the wire, in a manner that automatically maintains a relatively constant length of slack wire or slack. The intended purpose for the automatic wire de-spooler according to the present invention is to provide a source of slack wire to wire bonding machines of the type used to make fine wire connections to microelectronic circuits.

The automatic wire de-spooler according to the present invention includes a spool drive assembly consisting of a drive motor coupled to a flanged hub adapted to engage the inner cylindrical surface of a wire spool slid axially over the hub. Wire paid off the spool passes forward through a hairpin-shaped bail which is generally vertically oriented, and is held in a slack condition against the inner wall of the curved lower transverse edge of the bail by pressurized air discharged from a nozzle directed axially into the open transverse end of the bail. Wire forward of the bail passes through an exit opening in the front of the apparatus, to a wire bonding machine.

The de-spooler apparatus includes a proximity sensor located forward of the bail and alongside the plane in which the wire exits the apparatus. When external tension is placed on the wire sufficient to reduce the length of the slack portion of the wire within the bail, thereby raising the wire into the detection range of the proximity sensor, an electrical signal is generated by the sensor and inputted into electronic control circuitry that initiates forward rotation of the drive motor. Forward rotation of the motor causes wire to be paid off the supply spool, increasing slack length sufficiently to move wire down away from the proximity sensor into the bottom of the bail, thereby interrupting forward drive current to the motor. Thus, the apparatus automatically supplies wire on demand, while maintaining closed-loop servo control of slack in the wire.

The preferred embodiment of the automatic wire despooler according to the present invention also includes an "end-of-spool sensor." In the preferred embodiment, the end-of-spool sensor includes a conductive rod mounted parallel to the outer cylindrical surface of the wire spool, and rearward of the bail. When a "negative draw" or rearward directed tension is exerted on the end of the wire attached to the nearly empty spool, as the spool is driven forward by the motor, the wire is drawn into contact with the conductive rod. Contact of the wire with the conductive rod closes an electrical circuit which operates audible and visible end-of-spool alarm signals. Preferably, the end-of-spool signal is also used to drive the motor in the reverse direction, when a motor drive command signal is received with the end-of-spool signal present. Reverse rotation of the drive motor reduces excess slack which may have inadvertently developed and falsely actuated the end-of spool sensor.

DETAILED DESCRIPTION OF THE INVENTION

Referring now to FIGS. 1–7, an automatic wire de-spooler for wire bonding machines, according to the present invention, is shown.

Figure 1:
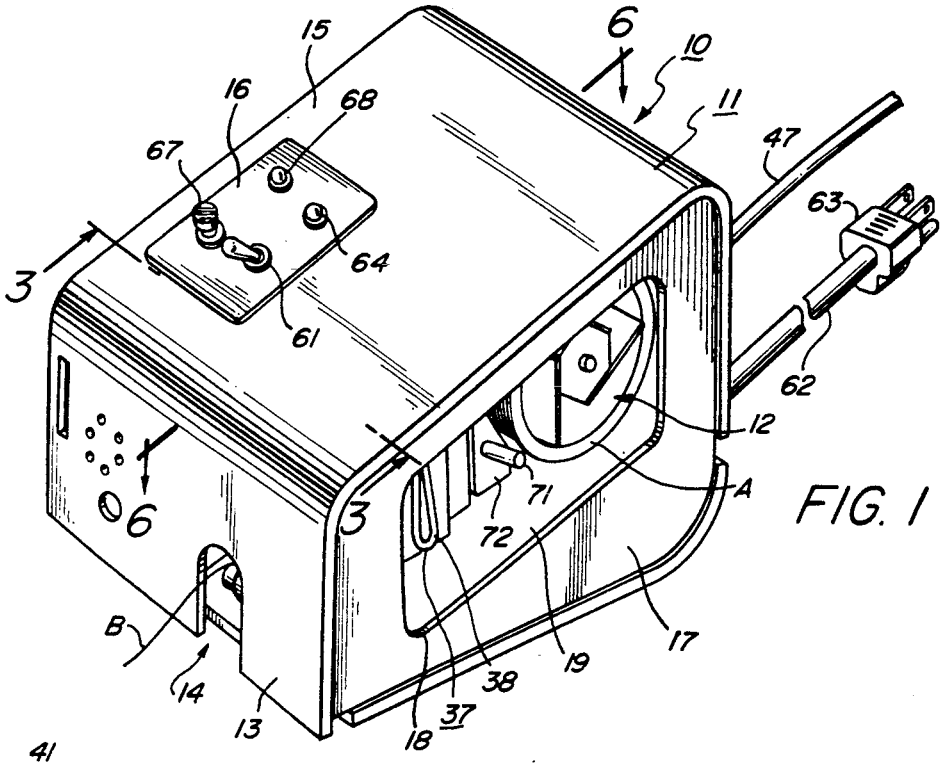
FIG. 1 is an upper right-side perspective view of an automatic wire de-spooler according to the present invention.

As shown in FIG. 1, the automatic wire de-spooler 10 according to the present invention includes a housing 11 which encloses a spool mount 12 for holding a wire spool A. Wire B, paid out from spool A in a manner described below, exits housing 11 through an arch-shaped opening 14 in a front panel 13 of the housing. A control panel 16 containing switches and indicators is mounted on upper panel 15 of housing 11. The function of these controls and indicators will be described in detail below.

As shown in FIG. 1, housing 11 includes a removable right side panel 17 having an opening 18 behind which is fastened a transparent viewing window 19.

Figure 2:
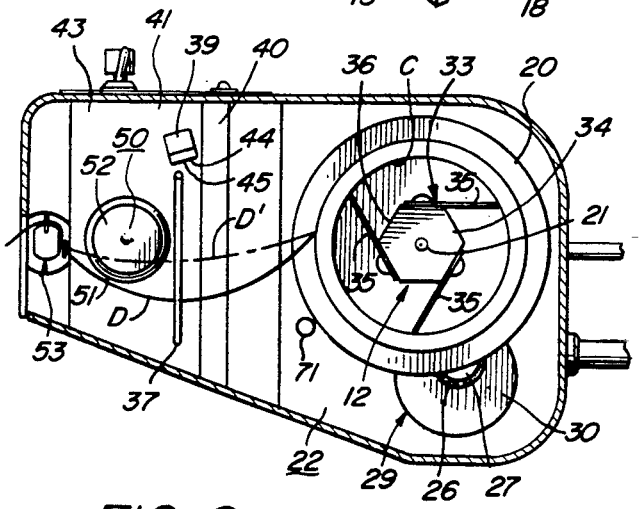
FIG. 2 is a right-side elevation view of the despooler of FIG. 1, showing a right-side access panel thereof removed.

FIG. 2 shows de-spooler apparatus 10 with right side panel 17 removed to allow replacement of a wire spool A on spool mount 12 of the apparatus. As shown in FIG. 2, spool mount 12 includes a circular inner end plate 20 of larger diameter than spool A. A coaxial axle 21 attached to end plate 20 protrudes below the end plate and is rotatably supported by a bearing (not shown) which is attached to a support plate 22 which is longitudinally disposed approximately midway between the sides of housing 11. Support plate 22 is attached to the inner walls of housing 11, and divides the interior space of the housing into right and left sides 23 and 24, respectively.

Figure 3:
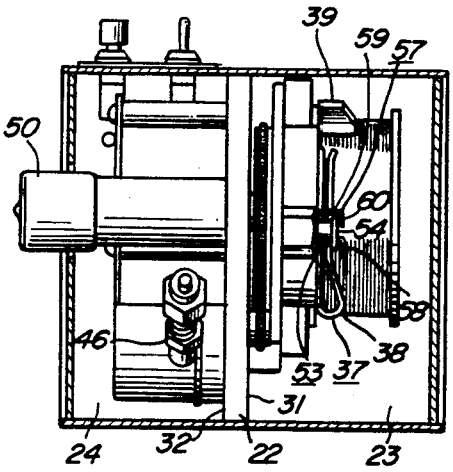
FIG. 3 is a front sectional view of the de-spooler of FIG. 1, taken along line 3—3 of FIG. 1.
Figure 6:
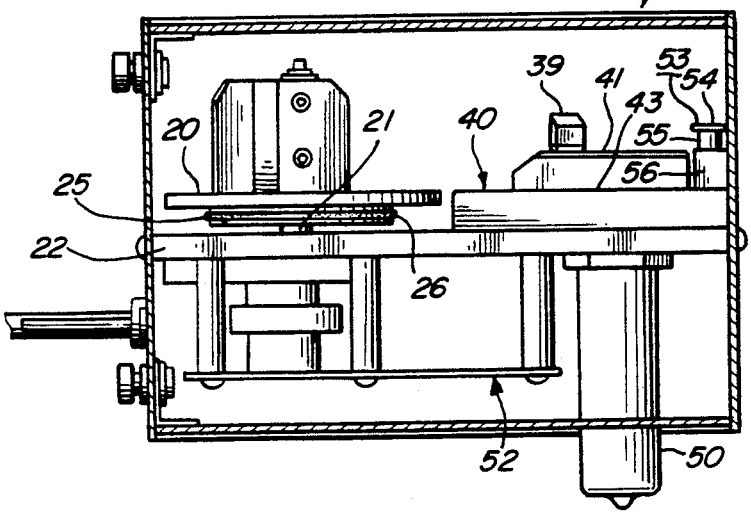
FIG. 6 is a sectional upper view of the de-spooler of FIG. 1, taken along line 6—6 of FIG. 1.

As may be seen best by referring to FIGS. 3 and 6, a spool-mount pulley 25, located between end plate 20 and support plate 22, is attached coaxially to axle 21. As shown in FIG. 2, spool-mount pulley 25 is driven by an endless belt 26 which is looped around a drive pulley 27 attached to the shaft 28 of an electrical motor 29. Motor 29 is mounted to support plate 22 with the front wall 30 of the motor positioned inward of the right hand wall 31 of the support plate. As shown in FIG. 6, the body of motor 29 protrudes beyond left-hand wall 32 of support plate 22 into left-hand interior space 24 of housing 11.

Referring again to FIG. 2, spool mount 12 may be seen to include a spider 33 for frictionally engaging the inner cylindrical surface C of a wire spool A. Spider 33 includes an elongated hexagonal cross section hub 34 fitted coaxially over axle 21 of spool mount 12. Hub 34 is attached to end plate 20 and protrudes outwards from the end plate. Three flat spring steel flange plates 35 are attached flat against three different flat faces 36 of hexagonal hub 34, spaced apart at 120 degree angles. Thus, flange plates 35 lie in chordal rather than radial planes of circular end plate 20. Therefore, when a wire spool A is slipped over flange plates 35, the outer ends of the plates contact inner cylindrical surface C of the spool obliquely, rather than radially. This arrangement permits flange plates 35 to frictionally engage inner cylindrical surface C of a wire spool A, while bending to accommodate spools having inner diameters slightly smaller than the nominal diameter which spool mount 12 is intended to accommodate.

De-spooler apparatus 10 includes means for causing a length D of wire B from spool A to be slack, as shown in FIG. 2. Thus, as shown in FIG. 2, a curved slack length of wire D threaded through a generally vertically oriented, hairpin-shaped bail 37 is biased towards the bottom curved portion 38 of the bail by the flow of pressurized air. That pressurized air is discharged downward towards curved wire D and bottom curved portion 38 of bail 37 from a nozzle 39 attached to the right-hand surface 41 of a stand-off plate 40. Stand-off plate 40 is disposed perpendicularly between upper wall 15 and lower wall 42 of housing 11, and attached to the upper and lower walls.

Figure 4:
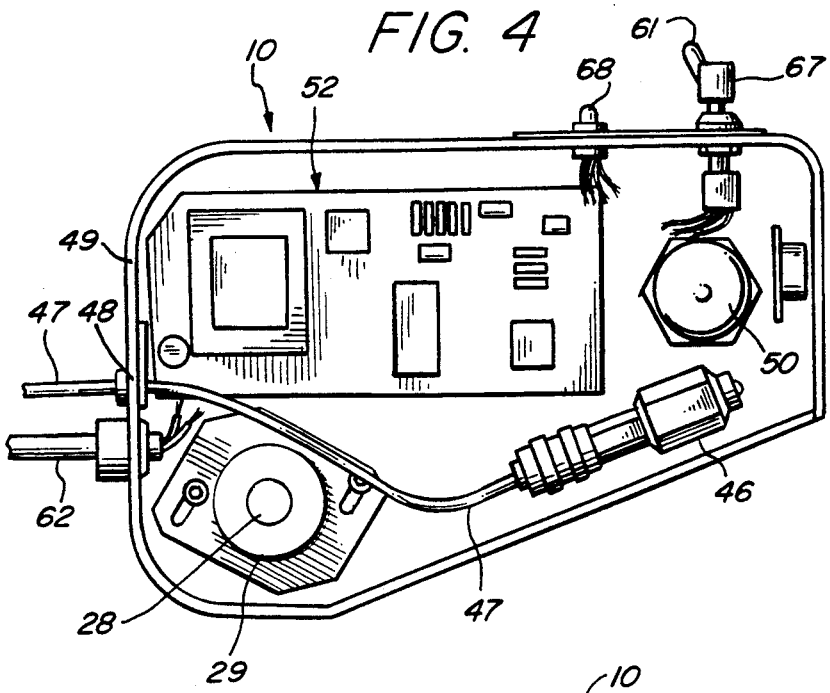
FIG. 4 is a left-side elevation view of the de-spooler of FIG. 1, showing a left side cover panel thereof removed.

As shown in FIG. 2, stand-off plate 40 has a relatively thick main section 43. Main section 43 of stand-off plate 40 has an internal passageway (not shown) that communicates with an outlet orifice 45 in the lower face 44 of discharge nozzle 39. The internal passageway also communicates with the outlet port of an adjustable flow-rate control valve 46, located in left-hand interior space 24 of housing 11, as shown in FIG. 4. The inlet port of flow control valve 46 is connected to a flexible air supply hose 47 that passes through opening 48 in rear panel 49 of housing 11. Air supply hose 47 is adapted for connection to an external supply of pressurized air, not shown.

De-spooler apparatus 10 also includes means for automatically starting and stopping drive motor 29, thereby paying out wire B from spool A. Thus, as shown in FIG. 2, de-spooler apparatus 10 includes a feed sensor 50 mounted in an opening 51 in main section 43 of stand-off plate 40. Feed sensor 50 has an end wall 52 that is substantially flush with the right-hand surface 41 of main section 43 of stand-off plate 40.

The purpose of feed sensor 50 is to produce a signal which causes motor 29 to rotate in a forward direction, when shortening of curved slack length D of wire B is detected. Thus, as shown in phantom in FIG. 2, when slack length D of wire B is decreased because of either forward or reverse tension in the wire, the slack length D moves into the position D', adjacent to feed sensor 50. With wire D sufficiently close to feed sensor 50, an electrical output signal is emitted by the sensor. This signal is coupled to an electronics module 52, shown in FIG. 4 and in block diagram form in FIG. 7.

Electronics module 52 includes signal processing circuitry for amplifying and shaping the signal from feed sensor 50, and thresholding circuitry to produce a logic true signal when the output signal from the feed sensor exceeds a threshold value indicating a pre-determined proximity of slack length D of wire B to the feed sensor. The aforementioned circuitry is indicated collectively as level detector 50 in FIG. 7. Electronics module 52 also contains logic circuitry and motor drive circuitry connected to input terminals of motor 29, which produce a signal effective in rotating the motor and spool mount 12 in a forward, or counter-clockwise sense, as viewed from the right-hand side, as shown in FIG. 2. Motor drive circuitry includes motor control logic 66, and forward and reverse relays 76 and 77, respectively.

Forward motion of wire spool A attached to spool mount 12 feeds wire B forward, increasing the length of slack portion D of the wire. Pressurized air from nozzle 39 facilitates movement of slack length D downward towards bottom curved portion 38 of bail 37. When slack length D of wire B has moved a predetermined distance downward away from feed sensor 50, the output signal from the feed sensor decreases to a value below the threshold value for causing a drive signal to be applied to motor 29. This reduction of the feed sensor signal below the threshold interrupts drive current to the motor, thereby ceasing rotation of the motor and feeding of wire B.

Feed sensor 50 may be of any type that is responsive to the presence of fine bonding wire, having a diameter as small as about 0.001 inch, in front of the sensor. We have found that a capacitive proximity switch performs the required functions of feed sensor 50. In particular, we found that a type KGE 2008-FRKG capacitive proximity switch, manufactured by IFM Detector, Inc., 805 Springdale Drive, Exton, Pa. 19341 is capable of detecting bonding wire of the minimum required size and at the required distance for proper control of the length of slack length D of wire B.

As may be seen best by referring to FIGS. 2 and 3, that portion of wire B forward of feed sensor 50 and slack length D passes over a fixed guide spindle 53 and out through a perforation 14 in front panel 13 of housing 11. As shown in FIG. 2, guide spindle 53 has a generally cylindrical shape, with an enlarged outer head 54, an elongated reduced diameter portion 55, and an enlarged base 56. Preferably, spindle 53 is provided with upper and rear L-shaped wire retaining clips 57 and 58. Retainer clips 57 and 58 are fabricated from steel spring wire bent to have an elongated straight portion 59 adjacent reduced diameter portion 55 of guide spindle 53, and a short end leg 60 bent at ninety degrees to elongated portion 59, and in contact with enlarged outer head 54 of the spindle.

Figure 7:
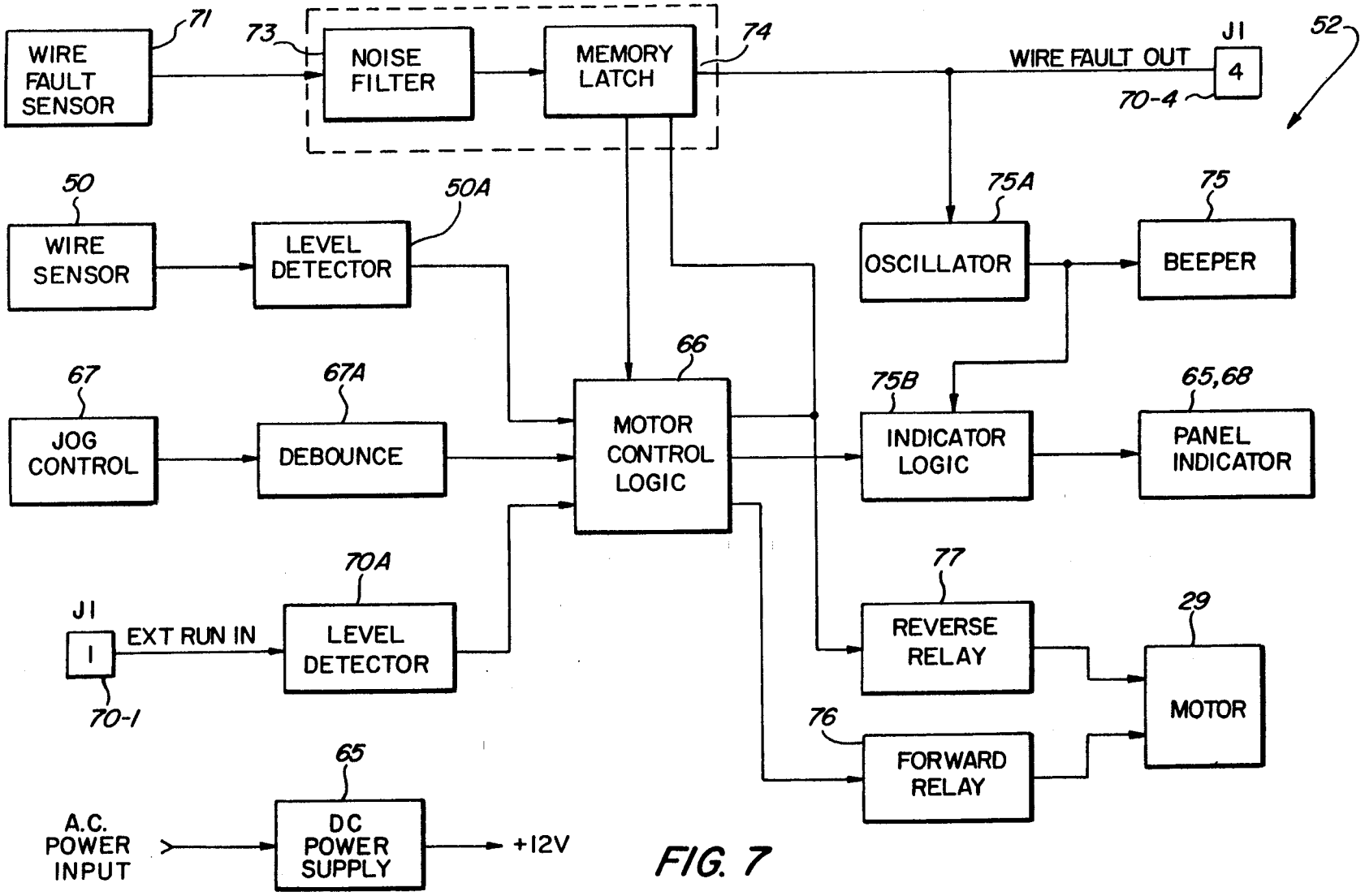
FIG. 7 is a block diagram of control electronics of the de-spooler of FIG. 1.

As shown in FIGS. 1 and 6, de-spooler apparatus 10 includes a control panel 16 mounted on upper panel 15 of housing 11, near the front edge of the upper panel. A power switch 61 mounted on control panel 16 is connected in series with a power cord 62 and plug 63, and with electronics module 52. With switch 61 in the ON position, and plug 63 connected to a source of external AC electrical power, a "power-on" indicator lamp 64 is energized by the AC power, which is also conducted to a DC power supply 65 and motor drive switching circuits 66 in electronics module 52, as shown in FIG. 7. Power supply 65 provides low-voltage DC power required by circuitry in electronics module 52.

Also mounted on control panel 16 is a "JOG" switch 67. JOG switch 67 is connected to a de-bounce circuit 67A port of electronics module 52. When JOG switch 67 is manually actuated, motor drive circuitry 66 within electronics module 52 applies a forward rotation drive signal to motor 29, whether or not sensor 50 is outputting a signal. Thus, actuating JOG switch 67 permits an operator to manually feed wire, after having placed a new wire spool A on spool mount 12, for example. A motor-run indicator lamp 68 mounted on control panel 16 is connected to motor drive circuitry in electronics module 52, and is illuminated whenever power is applied to motor 29.

Figure 5:
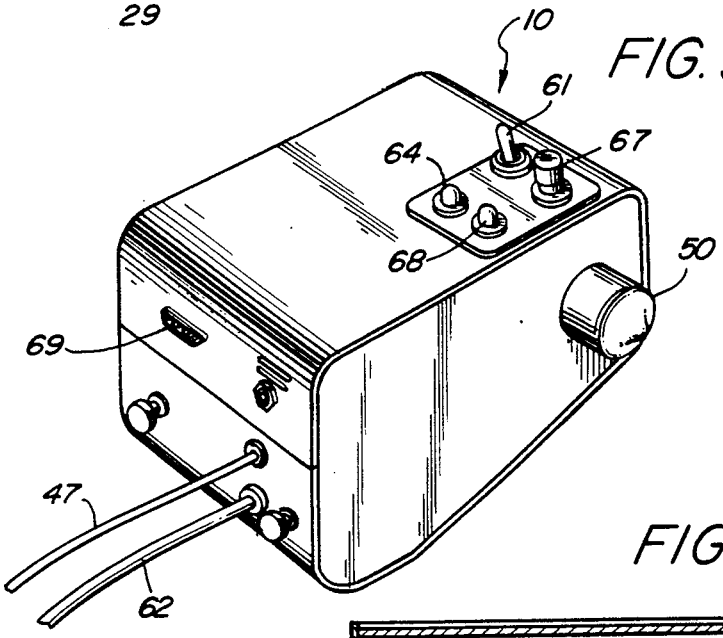
FIG. 5 is a rear perspective view of the de-spooler of FIG. 1.

Preferably, de-spooler 10 includes a bonder interface connector 69, which may be mounted on rear panel 49 of housing 11, as shown in FIG. 5. Bonder interface connector 69 is connected to an input port 70-1 of electronics module 52. Input port 70-1 is connected to logic circuitry 70A within electronics module 52 that permits external control signals produced by a bonding machine to cause motor 29 to rotate, feeding wire as required by the bonding machine. Preferably, bonder interface connector 69 also includes terminals which may be used to convey status signals from electronics module 52 to an external wire bonding machine, as will be explained in detail below.

The preferred embodiment of automatic wire de-spooler 10 according to the present invention also includes means for sensing when nearly all of the wire on a spool has been paid out, and for providing an indication of this "end-of-spool" condition. In an embodiment of an end-of-spool sensor shown in FIGS. 2 and 7, a conductive cylindrical pin 71 is mounted on an insulating base 72 on supporting plate 22, forward and below spool mount 12, at about a 7:00 o'clock position relative to the axis of spool mount 12. Conductive cylindrical pin 71, which protrudes outwards from supporting plate 22, is parallel to the axis of spool mount 12, and is electrically connected to an input terminal 73 of a conductivity sensor 74 in electronics module 52. The foregoing elements function collectively as an end-of-spool sensor in the following manner.

When wire B is drawn through opening 14 of de-spooler 10 for bonding, and slack length D of the wire is shortened sufficiently to move upwards adjacent to feed sensor 50, a signal produced by the feed sensor causes motor 29 to rotate wire spool A in a forward direction, thereby increasing the length of slack D, as has been previously described. However, when the end of a spool has been nearly reached, forward rotation of wire spool A causes the end portion of wire B attached to the spool to rotate in a counter-clockwise sense, producing a rearward directed tension or "negative draw" on the wire, and pulling the end portion of the wire into contact with conductive cylindrical pin 71. Since spool mount 20 conductively contacts metal support plate 22, spool A and wire B, when wire B contacts pin 71, input terminal 73 of conductivity sensor 74 become electrically grounded, thus producing an end-of-spool logic signal. This signal may be used to actuate audible or visual indicators to indicate an end-of-spool condition to an operator.

In applications where it is desired to provide an end-of-spool signal for insulated wire, cylindrical pin 71 may be replaced by a proximity sensor similar to the type used for feed sensor 50.

In the preferred embodiment, the internal end-of-spool logic signal is used to energize an oscillator 75A that drives an audible beeper 75, and indicator logic 75B that causes power-on pilot lamp 64 and motor run indicator lamp 68 to flash. The end-of-spool signal may also be used to conduct a fault signal via a conductor of bonder interface connector 69 to an external bonding machine, signifying to the operator of the machine that bonding operations must be halted until the empty wire spool in de-spooler 10 is replaced.

With de-spooler 10 provided with an end-of-spool sensor as described above, it is possible for a false end-of-spool indication to occur. Thus, if motor 29 is rotated too far forward, by external JOG commands, for example, an excess amount of wire may be paid out, sufficient for part of the wire to contact conductive cylindrical pin 71. This condition may be referred to as a "soft" fault, and distinguished from an actual end-of-spool condition by a visual observation made by an operator through viewing window 19 of de-spooler apparatus 10. In the preferred embodiment, motor reversal means 76 responsive to an end-of-spool detection are provided within electronics module 52. Thus, when an end-of-spool detection has occurred, and an operator has visually determined that the detection actually resulted from excessive slack, he may actuate the JOG switch. This will cause the motor to turn in the reverse sense (clockwise as viewed in FIG. 2), rewinding excess slack and lifting the wire from the end-of-spool sensor pin 71.

What is claimed is:

1. A de-spooler apparatus for paying out wire from a spool, said apparatus comprising;

(a) spool mount means for releasibly holding a spool containing wire, (b) driver means for controllably rotating said spool mount means, (c) outlet port means for allowing wire paid off from said spool to exit from said apparatus, (d) slack control means for maintaining a length of slack wire between said spool and said outlet port means, said slack control means comprising a looped structure located between said spool mount means and said outlet port means, said looped structure having an elongated aperture adapted to allow movement of said wire in directions both parallel to and transverse to travel of wire through said apparatus, and a transversely disposed end leg adapted to limit transverse motion in one direction of said wire, and (e) slack sensor means operatively interconnected with said spool mount drive means, whereby a signal generated by said slack sensor upon said slack length decreasing below a pre-determined value is effective in rotating said spool mount and said wire spool in a forward direction, paying off wire in a manner tending to increase said slack length.

2. The de-spooler apparatus of claim 1 wherein said slack control means is further defined as including loop bias means for biasing wire within said aperture of said slack control means towards said transversely disposed end leg and away from a straight line joining said outlet port and that point on said spool where wire is paid off from, thereby forming a slack loop of wire within said slack control means.

3. The apparatus of claim 2 wherein said loop bias means is further defined as being a stream of pressurized gas directed towards said slack loop and said transversely disposed leg of said slack control means.

4. The apparatus of claim 2 wherein said slack sensor is further defined as comprising means for sensing when said slack loop moves a pre-determined distance away from said transversely disposed leg of said slack control means.

5. The apparatus of claim 4 wherein said slack sensor is further defined as comprising means for sensing when a slack loop within said slack control means has moved to within a predetermined distance of said straight line joining said outlet port to said pay-off location of said spool.

6. The apparatus of claim 5 wherein said sensor is further defined as a proximity sensor.

7. The apparatus of claim 6 wherein said proximity sensor is further defined as being a capacitive proximity sensor.

8. A de-spooler apparatus for paying out wire from a supply spool to an external device such as a wire bonding machine, said de-spooler apparatus comprising;

a. a supporting structure comprising an internal component-mounting plate and an external housing, b. a spool mount assembly rotatably fastened to said component-mounting plate, said spool mount assembly being adapted to releasibly hold a hollow cylindrical spool of wire and to rotate said spool about its cylindrical axis when said spool mount assembly is rotated, c. a drive motor fastened to said component-mounting plate, d. coupling means for rotatably coupling said motor to said spool mount assembly, e. an outlet aperture in said housing for allowing wire paid off from said spool to exit said housing, f. a U-shaped bail having a short transverse leg and located between said spool mount assembly and said outlet aperture for holding a length of wire paid off from said spool in a curved slack condition, g. feed sensor means proximate said bail for producing a feed signal whenever said slack length of wire within said bail is shorter than a pre-determined value, and h. signal processing means responsive to said feed signal in producing a drive signal conducted to said motor and effective in rotating said motor, said spool mount assembly, and wire spool in a forward direction causing wire to pay off said spool, thereby increasing said slack length.

9. The apparatus of claim 8 further including means for biasing said slack length of wire towards the short leg of said U-shaped bail.

10. The apparatus of claim 9 wherein said biasing means is further defined as being a source of pressurized gas directed towards the inner edge of said short transverse leg of said bail.

11. The apparatus of claim 9 wherein said feed sensor means is further defined as being a proximity sensor, said proximity sensor producing a feed signal whenever said slack length of wire within said bail is shortened and moved sufficiently far away from said short transverse leg of said bail to be within a predetermined distance from said proximity sensor.

12. The apparatus of claim 9 wherein said signal processing means is further defined as being adapted to respond to an external command signal in applying a forward drive signal to said spool mount motor.

13. The apparatus of claim 12 further including an end-of-spool sensor for providing an end-of-spool signal when the last turn of wire has been paid out from said wire supply spool.

14. The apparatus of claim 13 further including reversing means for reversing the rotation direction of said wire spool mount upon the receipt of an external command signal, when said end-of-spool sensor signal is present.

15. The apparatus of claim 13 wherein said end-of-spool sensor is further defined as being actuated by tension exerted by attachment of wire to said spool, in a negative direction, away from said bail and towards said spool.

16. The apparatus of claim 15 wherein said negative-tension actuated end-of-spool sensor is further defined as being in combination;

a. an elongated electrically conductive member adjacent said wire spool, said conductive member protruding upward from an insulating mounting base, parallel to said wire spool and below the path of slack length of wire paid from said spool, whereby positive rotation of the taut end portion of wire attached to said spool brings said taut end portion into contact with said conductive member, and b. an electrical continuity detector connected in series with said wire on said spool and said conductive member, whereby contact between said wire and said conductive member produces a continuity signal signifying an end-of-spool condition.

17. The apparatus of claim 15 wherein said end-of-spool sensor is further defined as being a proximity sensor located adjacent said spool and below the path of slack wire paid from said spool.

18. A wire de-spooler apparatus for supplying fine wire from a supply spool to a wire bonding machine, said de-spooler apparatus incorporating means for maintaining a minimum amount of slack in wire withdrawn from the apparatus for use by said wire bonding machine, said despooler apparatus comprising;

a. a support structure comprising an internal longitudinally disposed component mounting plate and an external housing, b. a spool mount assembly rotatably fastened to said component mounting plate by means of a transversely disposed axle protruding outwards from said plate, said spool mount assembly having an inner end plate and an axially disposed spider assembly for engaging the inner cylindrical wall surface of a hollow cylindrical wire supply spool, c. an electrical drive motor fastened to said component mounting plate, d. coupling means for rotatably coupling said motor to said spool mount assembly, e. an outlet port for drawing wire from said de-spooler apparatus, said outlet port comprising in combination an aperture in said housing and a wire guide spindle fastened to said component mounting plate, adjacent the inner opening of said aperture.

f. a generally vertically disposed, hairpin-shaped bail fastened to said component mounting plate at a location longitudinally intermediate said wire guide and said spool mount assembly, said bail having an elongated U-shaped opening parallel to said component mounting plate, a lower short transverse leg, and an upwardly directed opening, g. a gas discharge nozzle located above said upwardly directed opening of said bail, said gas discharge nozzle being connectable to a source of pressurized gas and having an output orifice adapted to direct a stream of pressurized air downwards into said upwardly directed opening of said bail towards said lower short transverse leg of said bail, thereby biasing a length of wire within said bail into a downwardly convex, curved slack length, h. feed sensor means fastened to said mounting plate upwards from said lower transverse leg of said bail and forward of said bail, said feed sensor means adapted to produce a feed signal whenever said slack length of wire within said bail becomes sufficiently short to bring said wire within a pre-determined detection range of said feed sensor, and i. electronic control means responsive to said feed signal in producing an electrical drive signal adapted to cause forward motion of said drive motor, and of said spool mount assembly and wire spool coupled thereto, thereby paying wire off from said wire supply spool sufficient to increase said slack length of wire within said bail to a value that depresses said slack length below said predetermined detection range of said feed sensor, thereby interrupting drive current to said motor.

19. The de-spooler apparatus of claim 18 further including means for applying drive current to said drive motor upon receipt of an external drive command signal, independent of the presence of a feed sensor signal.

20. The de-spooler apparatus of claim 19 further including end-of-spool sensor means for producing an end-of-spool signal when nearly all of the wire has been paid off of a wire supply spool.

21. The de-spooler apparatus of claim 20 further including means for causing said drive motor, said spool mount assembly and said wire spool to rotate in a reverse direction when both external drive command and end-of-spool signals are present.

22. The de-spooler apparatus of claim 18 wherein said axially disposed spider assembly is further defined as being adapted to frictionally engage the inner cylindrical surfaces of wire spools over a range of sizes, said spider assembly comprising an elongated hub and a plurality of flexible plates lying on chords rather than radii of a circle concentric with said hub.

23. The de-spooler apparatus of claim 18 wherein said coupling means for rotatably coupling said motor to said spool mount assembly is further defined as comprising in combination;

a. a driver pulley fastened to the shaft of said motor, b. a driven pulley fastened to the axle of said spool mount assembly, and c. an endless belt looped around and engaging both said driver pulley and said driven pulley.

* * * * *